United States Patent [19]

Sud et al.

[11] Patent Number: 4,822,770

[45] Date of Patent: Apr. 18, 1989

[54] CARBONLESS COPY PAPER

[75] Inventors: Arun Sud; Sankar K. Paul, both of West Bengal, India

[73] Assignee: Business Forms Limited, India

[21] Appl. No.: 63,100

[22] Filed: Jun. 17, 1987

[51] Int. Cl.[4] ..... B41M 5/14; B41M 5/22

[52] U.S. Cl. ..... 503/214; 427/150; 427/151; 428/402.2; 428/402.21; 428/402.22; 428/914; 503/215; 503/225

[58] Field of Search ..... 427/150–152; 428/402.2, 402.21, 402.22, 914; 503/214, 215, 216, 225

[56] References Cited

U.S. PATENT DOCUMENTS

| | | | |
|---|---|---|---|
| 2,800,457 | 7/1957 | Green et al. | 503/215 |
| 3,554,781 | 1/1971 | Matsukawa | 503/215 |
| 3,900,216 | 8/1975 | Hayashi et al. | 427/150 |
| 4,064,294 | 12/1977 | Babil | 427/379 |
| 4,154,462 | 5/1979 | Golden et al. | 503/215 |
| 4,337,968 | 7/1982 | Maierson | 503/215 |
| 4,352,855 | 10/1982 | Hiraishi et al. | 503/215 |
| 4,371,634 | 2/1983 | Hoffman et al. | 503/215 |
| 4,411,451 | 10/1983 | Matsushita et al. | 503/215 |
| 4,421,344 | 12/1983 | Ikezawa et al. | 427/150 |
| 4,422,671 | 12/1983 | Cespon | 427/151 |

FOREIGN PATENT DOCUMENTS

| | | | |
|---|---|---|---|
| 0235161 | 11/1985 | Japan | 503/215 |

*Primary Examiner*—Bruce H. Hess

*Attorney, Agent, or Firm*—Stonebraker, Shepard & Stephens

[57] ABSTRACT

Carbonless copy paper is prepared by placing a first sheet of paper coated on one side with a hydrophilic colloid solution in which are dispersed microcapsules of oil droplets containing a colorless electron donor dye into contact with a second sheet of paper coated with an absorbent and an electron accepting color developer compound. The heat resistance and moisture resistance of the copy paper is substantially improved by adding to the hydrophilic colloid solution a graft copolymer having a backbone of carboxymethyl cellulose or gum arabic and side chains of polyacrylic acid or polymethacrylic acid. The image response time of the second sheet can be improved by adding pectin or sulfated starch to the coating.

8 Claims, No Drawings

CARBONLESS COPY PAPER

BACKGROUND

Carbonless copy paper usually consists of two or more sheets of coated paper. For example, when three sheets of paper are used, the top sheet has a coated back (CB) which is formed by coating the back or underside of the top sheet with a hydrophilic colloid solution in which are dispersed microcapsules containing a colorless electron donating chromogenic color former. The middle sheet is coated on its front and back (CFB). The coating on the front or upperside contains an electron accepting color developer, and the coating on the back or underside is the same as the microcapsule-containing coating on the top sheet. The bottom sheet is coated on its upperside or front (CF) with the same composition that is on the front of the middle sheet. Detailed disclosures of carbonless copy papers are included in U.S. Pat. Nos. 3,554,781; 4,154,462; 4,337,968; 4,352,855; 4,371,634; and 4,411,451.

In order to form an image with carbonless copy paper, the system utilizes the color forming reaction that takes place between the electron donating chromogenic material or color former in the coated back and the electron accepting acidic reactant material or color developer in the coated front (CF). The reactants are isolated from each other by microencapsulating one of them until an image is desired. When pressure is applied to the carbonless copy paper, the microcapsules are ruptured and a reaction occurs between the color former and color developer to provide the desired image. In the preferred type of carbonless copy paper, the color former is the reactant that is encapsulated by being dissolved in oil and microencapsulated prior to being used in the coating on the coated back.

A preferred method of making microcapsules containing color former reactants is the complex coacervation procedure described in U.S. Pat. No. 2,800,457. In this procedure an oil containing a color former is dispersed in two colloid materials that have opposite charges, and at least one is gellable. Coacervation of the hydrophilic colloid solution around each oil droplet is caused by dilution and adjusting the pH to the acidic range. The coacervate around each oil droplet is gelled by cooling and hardened by addition of a suitable hardening agent, and the pH of the mixture is adjusted to the alkaline range.

Carbonless copy papers that are produced from multi-nuclear and clustered microcapsules are subject to premature rupturing of the microcapsules during handling or during post-coating conversion processes, especially in the printing of business forms. Also, such copy papers have very poor humidity and heat resistance, and those copy papers have only very limited utility in hot, humid climates. Much effort has been expended to solve these problems by preparing coacervation microcapsules that are mononuclear and cluster-free. For example, maleic anhydride copolymers or carboxymethyl cellulose have been incorporated into the walls of the microcapsules, but these prior art procedures have not been successful, although reaction conditions were strictly maintained during the coacervation procedure.

Also, there are unsolved problems with the coated fronts that are used in prior art carbonless copy papers. Usually an acidic clay or an acidic polymer is used in the coated front. Images on acidic clay-coated paper are not sufficiently permanent and they have only limited resistance to moisture. Images on acidic polymer-coated paper are time and temperature dependent and frequently too slow. Better results are sometimes obtained by using a combination of acidic clay and acidic polymer, but image formation is still too slow, especially at low temperatures such as at 5° C.

SUMMARY OF THE INVENTION

It is an object of this invention to provide an improved carbonless copy paper that does not have the problems and disadvantages discussed above.

It is another object of this invention to provide an improved carbonless copy paper having the color former in microcapsules that are mononuclear and substantially cluster-free and are resistant to premature rupturing, especially at high humidity and high temperature.

It is a further object of this invention to provide an improved carbonless copy paper having a faster image formation capability, especially at low temperatures.

DETAILED DESCRIPTION

In accordance with this invention, we have found that an improved carbonless copy paper that has an improved resistance to smudging at high heat and humidity can be prepared by dispersing an electron donating chromogenic color former in a colloid solution in microcapsules that are mononuclear and cluster-free. The hydrophilic colloid solution contains a water soluble graft copolymer having a backbone of carboxymethyl cellulose or gum arabic and side chains of polyacrylic acid or polymethacrylic acid, said side chains comprising from 5 to 10 percent by weight of the copolymer.

The hydrophilic colloid solution is coated on one side of a sheet of paper to form a pressure-sensitive color transfer sheet, and the color transfer sheet is placed in contact with an electron accepting color developer that has been coated on a second sheet of paper. The resulting system is a pressure-sensitive carbonless copy paper that is resistant to smudging at high temperature and high humidity.

We have also found that the image response time of the second sheet of paper containing the color developer can be improved, particularly at low temperatures, such as 5° C., by incorporating pectin or sulfated starch in the acidic coating containing the color developer.

The coacervation procedure that is described in U.S. Pat. No. 2,800,457 is suitable for preparing the microcapsules containing color forming material that are used in preparing the carbonless copy paper of this invention. The preferred hydrophilic or colloid material that is used is an acid-treated gelatin; and in order to obtain mononuclear, cluster-free microcapsules, a graft copolymer is used with the acid-treated gelatin.

The graft copolymer contains carboxymethyl cellulose (CMC) or gum arabic (GA) as a backbone and polyacrylic acid or polymethacrylic acid in the side chains. The graft copolymers are carboxymethyl cellulose with polyacrylic acid (CMC-PAA) or polymethacrylic acid (CMC-PMA), and gum arabic with polyacrylic acid (GA-PAA) or polymethacrylic acid (GA-PMA).

The graft copolymers that are used contain from 5% to 10% by weight of polyacrylic acid (PAA) or polymethacrylic acid (PMA). When less than 5% by weight is used, the benefits of our invention are not achieved;

and when more than 10% by weight is used, the microcapsules have been found to agglomerate.

The amount of copolymer that is used, when expressed in relation to the amount of gelatin or other hydrophilic colloid material, is within the range of ⅛ to ¼ or 12.5% to 25% by weight.

The graft copolymers that are used can be prepared by a free radical polymerization technique. Free radicals are created on the carboxymethyl cellulose or gum arabic backbone by higher valence metallic ions, and the acrylic acid or methacrylic acid monomers are polymerized mainly on the chain of the substrate polymer. The graft copolymers can then be purified by the solvent-nonsolvent technique.

The carboxymethyl cellulose that is used to form the graft copolymers has an average degree of polymerization (DP) of 200–500 and a degree of substitution (DS) of 0.6 to 0.8. Commercial grades of gum arabic, acrylic acid, and methacrylic acid are also used.

Chromogenic materials that can be used as color formers are crystal violet lactone, benzoyl leucomethylene blue, malachite green lactone, rhodamine B-lactone, and fluoran derivatives, either alone or in combination.

Conventional hydrophobic materials are used, either alone or in combination. Typical examples are castor oil, alkyldiphenyl, biphenyl derivatives, naphthalene derivatives, alkylbenzene phthalic acid esters, and kerosene.

Coacervate hardening agents are also used, either alone or in combination. Suitable agents are formaldehyde, glyoxal, and glutaraldehyde. From 3–30 parts by weight of hardening agent per 100 parts of hydrophilic colloid material are used.

The preferred color developers are acidic polymers of thermoplastic materials having good solubility in oil. A preferred polymer is p-substituted phenol-formaldehyde novolac resin. The resin can be used in combination with an absorbent such as kaolin, attapulgite, and precipitated silica. In the polymer p-chloro phenol, p-octyl phenol, or p-tertiary butyl phenol can be used in place of p-phenyl phenol.

Binders that can be used with the color developers are polyvinyl alcohol, styrene-butadiene rubber (SBR) latex, carboxymethyl cellulose, hydroxyethyl cellulose, oxidized starch, and polyvinyl acetate emulsion. The most preferred binders are oxidized starch and styrene-butadiene rubber latex.

Anionic, cationic, and nonionic emulsifying agents can also be used with the color developer. Preferred emulsifiers are teepol, turkey red oil, tetrasodium pyrophosphate, cetyltrimethyl ammonium chloride, and polyoxyethylene dodecyl sulfonic acid. Suitable protective agents for the color developer are pectin, pectic acid, dialdehyde starch, sulfated starch, and ureaformaldehyde polymers. Sulfated starch and pectin are preferred.

The amount of pectin or sulfated starch that is used is within the range of 3 to 8% by weight of the color developer, for example, p-phenyl phenol formaldehyde resin. When sulfated starch is used, it is preferred that the degree of esterification be within the range of 0.55 to 0.65.

The following examples illustrate our invention. In these examples, parts and percentages are by weight unless otherwise indicated.

Preparation of Color Former Microcapsules

EXAMPLE I 100 parts acid treated gelatin is dissolved in 1200 parts water at 45° C. and 600 parts KMC-113 (alkylnapthalene) containing 12 parts crystal violet lactone is emulsified into the gelatin solution to a particle size of 5–8μ. To the emulsion, 1000 parts 2.5% CMC solution (DP=300 & DS=0.6) in water is added gradually under mild stirring. Then 300 parts warm water are added and stirred for another 15 minutes. The pH of the mixture is adjusted to 5.0–5.5 with 10% sodium hydroxide in water. The mixture is then cooled externally under constant stirring and 50 parts of formaldehyde (37%) is added to it. The pH of the system is then adjusted to 10.0 with 10% sodium hydroxide solution.

EXAMPLE II

Example I is repeated by using a CMC (DP=300 & DS=0.6)-graft copolymer containing 10% PAA, instead of CMC alone.

EXAMPLE III

Example I is repeated by using a CMC (DP=300 & DS=0.6)-graft copolymer containing 10% PMA, instead of using CMC alone.

EXAMPLE IV

Example I is repeated by using gum arabic (GA) in place of carboxymethyl cellulose (CMC).

EXAMPLE V

Example I is repeated by using a GA-graft copolymer containing 10% PAA in place of CMC alone.

EXAMPLE VI

Example I is repeated by using GA-graft copolymer containing 10% PMA in place of CMC alone.

To each of the above capsule dispersions, 150 parts cellulose powder, 75 parts starch, and 200 parts 10% partially hydrolysed polyvinyl alcohol are added and the final composition coated at 5 g/m$^2$ onto a 50 g/m$^2$ base paper.

The coated papers with microcapsules (Examples I–VI), i.e. the CB sheets, are tested by using the following procedures and the results are presented in the comparative analytical table (Table I).

TEST PROCEDURES

(i) Capsule nature and cluster

This test is done with a microscope of 1500x magnification by taking capsule suspensions onto a slide and counting the number of clusters per 100 capsules under the microscope.

(ii) Heat and humidity resistance

Coated papers from the capsule suspensions are kept in an air oven at 150°±2° C. for testing heat resistance and in a humidifier at 50°±0.5° C. and 98% RH for testing the humidity resistance.

(iii) Humidity resistance under weight

This is considered to be a measure of the smudge resistance of the carbonless paper. Coated papers from the capsule suspensions (CB) are placed on the CF coated papers face to face, under weight in a humidifier at 50°±0.5° C. and 98% RH.

(iv) Hardening time

This is the time required for dropwise addition of a sodium hydroxide solution in water to make the pH of the prematured capsule suspension at 10° C. reach the range of 10.0–10.5.

TABLE I

Comparative Analytical Table (CB)

| Example 1 | Capsule Shape 2 | Cluster/ 100 Capsules 3 | Heat Resistance 4 | Humidity Resistance 5 | *Humidity Resistace under Weight 6 | Hardening Time (minutes) 7 |
|---|---|---|---|---|---|---|
| I | Mixture of Multi-nuclear & Mononuclear | 15 ± 5 | 4 hrs. at 150° C. | ½ hr. @ 50° C. & 98% RH | ¼ Kg/in² @ 50° C. & 98% RH for ¼ hr. | 40 ± 5 |
| II | Mononuclear | 1 | 7 hrs. at 150° C. | 1 hr. @ 50° C. & 98% RH | ½ Kg/in² @ 50° C. & 98% RH for ½ hr. | 15 ± 5 |
| III | Mononuclear | 1 | 7 hrs. at 150° C. | 1 hr. @ 50° C. & 98% RH | ½ Kg/in² @ 50° C. & 98% RH for ½ hr. | 15 ± 5 |
| IV | Multi-nuclear | 25 ± 5 | 3 hrs. at 150° C. | ½ hr. @ 50° C. & 98% RH | ¼ Kg/in² @ 50° C. & 98% RH for ¼ hr. | 45 ± 5 |
| V | Mononuclear | 5 ± 2 | 6 hrs. at 150° C. | 1 hr. @ 50° C. & 98% RH | ½ Kg/in² @ 50° C. & 98% RH for ½ hr. | 20 ± 5 |
| VI | Mononuclear | 5 ± 2 | 6 hrs. at 150° C. | 1 hr. @ 50° C. & 98% RH | ½ Kg/in² @ 50° C. & 98% RH for ½ hr. | 20 ± 5 |

It is observed that for Examples II, III, V, and VI, the resistance is almost four times (giving equal emphasis to weight and time) that of Examples I and IV.

The following observations are found with the CB coated papers and the microcapsules used for making the CB sheets according to the process of the invention (Examples II, III, V, and VI):

(i) The average capsule size is 5–8μ.

(ii) For all practical purposes, the microcapsules are mononuclear and cluster-free when compared to those obtained in Examples I and IV.

(iii) The humidity resistance of the CB sheets is relatively higher.

(iv) The humidity resistance under weight, or in other words the smudge resistance of the microcapsule coatings, is far better than that as obtained in Examples I and IV.

(v) The coated papers are not affected when stored at lower temperatures like 5° C.

(vi) Up to seven clear copies on 50 g/m² base paper are obtained.

Preparation of Color Developer

EXAMPLE A 60 parts precipitated silica and 40 parts kaolin are dispersed in 180 parts water under stirring. To the dispersion, 100 parts 25% p-phenyl phenol formaldehyde resin, 100 parts 20% oxidized starch solution in water, and 20 parts 50% SBR latex are added and mixed thoroughly in a ball mill.

EXAMPLE B 60 parts precipitated silica and 40 parts kaolin are dispersed in 180 parts water containing 5 parts pectin under stirring. To the dispersion, 100 parts of 25% p-phenyl phenol formaldehyde resin, 100 parts 20% oxidized starch solution in water, and 20 parts 50% SBR latex are added and mixed thoroughly in a ball mill.

EXAMPLE C

Example B is repeated by using 5 parts sulfated starch instead of 5 parts pectin.

The final compositions from each of these examples are coated at 5 g/m² onto a 50 g/m² base paper.

These coated papers (Examples A, B, and C), i.e. the CF sheets, are tested by using the following procedures and the results are presented in the comparative analytical table (Table II).

TESTING PROCEDURES (i) Humidity resistance

This is considered to be a measure of the life of the CF paper in an acceptable active condition. Coated papers are kept in a humidifier at 50° C.±0.5° C. and 98% RH for 4 hours.

(ii) Image formation

CB and CF papers are conditioned at 5° C.±0.5° C. and tested by writing with a ball point pen. Similar testing is done at 30° C. also.

| (iii) Image stability | |
|---|---|
| (a) Water resistance | Copies on CF sheets are washed under a stream of tap water. |
| (b) Solvent resistance | Copies on CF sheets are rubbed by cotton soaked with benzene, toluene, and acetone. |
| (c) Ultraviolet resistance | Copies on CF sheets are kept under an ultraviolet light source situated 100 mm away from the image. |
| (d) Sunlight resistance | Copies on CF sheets are exposed to sunlight for 1 hour. |

TABLE II

Comparative Analytical Table (CF)

| | Example A | B | C |
|---|---|---|---|
| Moisture resistance of CF paper | d* | b | b |
| Image formation at 30° C. | b | a | a |
| Image formation at 5° C. | d | a | a |
| Image Stability: | | | |

TABLE II-continued

| Comparative Analytical Table (CF) | Example | | |
|---|---|---|---|
| | A | B | C |
| Water resistance | a | a | a |
| Solvent resistance | d | c | c |
| Ultraviolet resistance | c | c | c |
| Sunlight resistance | d | c | c |

*Ratings:
a = very good
b = good
c = satisfactory
d = relatively unsatisfactory

The following observations are found with the CF coated papers and the images developed therein according to the process of the invention (Examples B and C):

(i) Image formation is relatively quick at 30° C. as well as at 5° C. and much faster than that as obtained in Example A.

(ii) The coated papers have a relatively good moisture resistance.

(iii) The image stability is good which is demonstrated by the fact that the image has good resistance to water, solvents, ultraviolet light, and sunlight.

We claim:

1. A pressure-sensitive color transfer sheet containing an electron donating chromogenic color former for use in combination with a second sheet containing an electron accepting color developer, said color former being dispersed in substantially cluster-free microcapsule form in a hydrophilic colloid solution containing a water soluble graft copolymer having a backbone of carboxymethyl cellulose or gum arabic and side chains of polyacrylic acid or polymethacrylic acid, said side chains comprising from 5 to 10 percent by weight of said copolymer.

2. A pressure-sensitive color transfer sheet according to claim 1 wherein the hydrophilic colloid solution comprises gelatin and the graft copolymer.

3. A pressure-sensitive color transfer sheet according to claim 2 wherein the amount of graft copolymer is within the range of $\frac{1}{8}$ to $\frac{1}{4}$ by weight of the amount of gelatin.

4. A carbonless copy paper color transfer system comprising a pressure-sensitive color transfer sheet having one side coated with a layer containing an electron donating chromogenic color former, said layer being in contact with a second layer coated on a second sheet, said second layer containing an electron accepting color developer, said color former being dispersed in substantially cluster-free microcapsule form in a hydrophilic colloid solution containing a water soluble graft copolymer having a backbone of carboxymethyl cellulose or gum arabic and side chains of polyacrylic acid or polymethacrylic acid, said side chains comprising from 5 to 10 percent by weight of said copolymer.

5. A carbonless copy paper according to claim 4 wherein the hydrophilic colloid solution comprises gelatin and the graft copolymer.

6. A carbonless copy paper according to claim 5 wherein the amount of graft copolymer is within the range of $\frac{1}{8}$ to $\frac{1}{4}$ by weight of the amount of gelatin.

7. A carbonless copy paper according to claim 4 wherein the second layer containing the color developer also contains pectin or sulfated starch.

8. A carbonless copy paper according to claim 4 wherein the color developer is p-phenyl phenol formaldehyde resin.

* * * * *